United States Patent [19]

De Laat

[11] Patent Number: 4,650,735

[45] Date of Patent: Mar. 17, 1987

[54] METHOD OF MANUFACTURING A METAL MATRIX AND AN INTERMEDIATE PRODUCT OBTAINED IN PERFORMING THE METHOD

[75] Inventor: Antonius W. M. De Laat, Eindhoven, Netherlands

[73] Assignee: U.S. Philips Corporation, New York, N.Y.

[21] Appl. No.: 456,877

[22] Filed: Jan. 10, 1983

[30] Foreign Application Priority Data

Oct. 14, 1982 [NL] Netherlands ..... 8203975

[51] Int. Cl.[4] ..... G03C 3/00

[52] U.S. Cl. ..... 430/16; 430/320; 430/324; 430/394; 430/945; 430/326; 346/76 L; 346/135.1

[58] Field of Search ..... 430/320, 394, 324, 16, 430/945, 326; 346/135.1, 76 L; 358/342, 345

[56] References Cited

U.S. PATENT DOCUMENTS 4,259,433 3/1981 Mizobuchi et al. ..... 430/296

4,308,337 12/1981 Roach et al. ..... 430/296

*Primary Examiner*—John E. Kittle

*Assistant Examiner*—José G. Dees

*Attorney, Agent, or Firm*—Norman N. Spain

[57] ABSTRACT

A method of manufacturing a metal matrix in which a supporting plate bearing a photo-resist layer is irradiated patternwise, the irradiated parts are developed and thereby removed, the obtained master disc is provided with a metal peel, which subsequently is removed, whereby after removal of the patternwise irradiated parts of the photoresist layer, the remaining parts are irradiated. The invention also relates to a new intermediate product which comprises a supporting layer, a photoresist layer having an information track and an electrically conductive layer on the photoresist layer, the photoresist layer being a fully irradiated layer.

4 Claims, 4 Drawing Figures

METHOD OF MANUFACTURING A METAL MATRIX AND AN INTERMEDIATE PRODUCT OBTAINED IN PERFORMING THE METHOD

BACKGROUND OF THE INVENTION

The invention relates to a method of manufacturing a metal matrix which comprises an information track on at least one side, in which a supporting plate is provided with a photoresist layer on at least one side, the photoresist layer is irradiated patternwise and is then developed, the irradiated parts of the photoresist layer being removed and an information track being formed, the resulting master disc is provided, on the side of the photoresist layer, with an electrically conductive layer on which a metal layer is provided by electrodeposition and the resulting metal peel in which the information track of the resist layer is copied is separated from the master disc.

The metal peel comprises the metal layer provided by electrodeposition and a top layer connected thereto consisting of the above-mentioned electrically conductive layer which preferably is also a metal layer.

The disadvantage of this method is that after separation from the master disc, portions of the photoresist material adhere to the metal peel. Removal of these adhering portions leads to damage or contamination of the peel. The mechanical removal of the adhering portions of photoresist will inevitably cause damage. Moreover it is an expensive and time-consuming process. The use of organic solvents causes environmental pollution and consequently a laborious and expensive recovery has to take place. The treatment with organic solvents moreover causes, as a result of the rapid evaporation of the solvent, contamination of the surface of the peel in the form of so-called drying spots which are very persistent and difficult to remove.

BRIEF SUMMARY OF THE INVENTION

The method according to the invention does not exhibit the above-mentioned disadvantages.

In particular the invention relates to a method as described above which is characterized in that after removal of the patternwise irradiated parts of the photoresist layer, the remaining parts of the photoresist layer are irradiated.

By employing the method of the invention the por tions of the photoresist material adhering to the metal peel can easily be removed from the metal peel by dissolving them in an aqueous medium, in particular an aqueous alkaline medium.

Preferably adhering portions of the photoresist material present on the peel are removed by dissolution in a developing liquid. By this means an optimal removal of the adhering portions of the photoresist material is obtained because the developing liquid is intended especially to dissolve irradiated photoresist material.

In the method in accordance with the invention the usual positive photoresist material may be used, in particular the photoresist materials which are sensitive to short-wave light, for example, UV light. Examples of such materials are photolacquers employing of naphtoquinone diazide, for example, the positive photoresist known by the commercial names of Shipley and Hunt Waycoat.

By using the method in accordance with the invention the quality of the manufactured matrix, of the further matrices derived herefrom and of the information carriers formed of synthetic resin which are manufactured by means of the matrices is significantly improved. This improvement in quality is of particular importance in the manufacture of matrices the information track or pattern of which has a very finely detailed structure. A clear example hereof is a matrix having an optically readable information track. Such matrices are used for the manufacture of information carriers formed of synthetic resin discs having an optically readable information track which comprises video (picture) or audio (sound) information. These synthetic resin discs are known as of VLP (video long play) or ALP (audio long play) discs. The information track of such matrices and synthetic resin discs has a crenellated profile of information areas situated at a higher level and at a lower level. The areas are read in reflection by means of laser light. Reading is based on the phase difference between the forward and the reflected laser light beam. The difference in height between the areas is $(n\lambda)/4d$, where $\lambda$ is the wavelength of the laser light, n is an integer and d is the refractive index.

According to the method of the invention first the photoresist layer is irradiated in the form of a pattern, the resist layer is then developed and subsequently the remaining parts of the resist layer are irradiated.

DETAILED DESCRIPTION OF THE INVENTION

Figure 1:
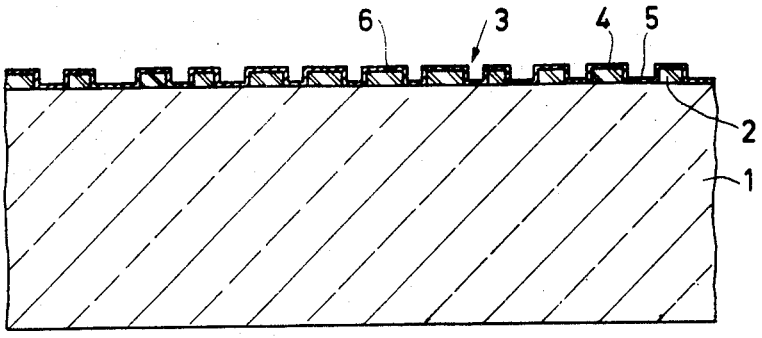
FIG. 1 is a cross-sectional view of an intermediate product of the invention.

According to one embodiment of the invention the patternwise irradiation can be carried out by irradiation via a mask which has recesses in accordance with the information to be provided.

According to another embodiment of the invention the photoresist layer may be irradiated by short-wave length laser light, for example UV laser light, pulsated in accordance with the information thereby carrying out the patternwise irradiation.

In a favorable embodiment of the method in accordance with the invention the remaining parts of the resist layer firstly are irradiated and then provided with the electrically conductive layer.

When this embodiment is employed the remaining parts of the photoresist layer can be irradiated from the air. In the presence of an electrically conductive layer, for example a metal layer, the remaining parts of the resist layer must be irradiated via the supporting plate. The disadvantage of this latter procedure that the supporting plate must be transparent to the light used, in particular short-wave length light, for example UV light. The supporting plate normally is manufactured from glass. The glass absorbs UV light as a result of which the exposure (irradiation) via the supporting plate occurs with difficulty. As a result in this case a quartz supporting plate would have to be used, which, of course is very expensive.

The electrically conductive layer may be, for example, a layer of titanium nitride provided by a sputtering process. However the conductive layer is preferably a metal layer, for example, in particular an Ag or Ni layer. Such a metal layer is provided by electroless deposition, for example a vapor deposition process, a sputtering process or an electroless plating process. According to the last mentioned process the photoresist layer is treated with an aqueous solution of a salt of the desired metal and subsequently or simultaneously, with an aqueous solution of a reduction agent in which the metal ion is reduced to a metal atom and a metal layer is formed. If, for example, the photoresist layer is to be provided with an Ni layer, the surface of the resist layer is treated with an aqueous, neutral or weakly acid solution of $NiSO_4$ and subsequently or simultaneously with an aqueous solution of hypophosphite or boronhydride. Such metallization processes have been well known for many years. Reference may be made, for example to "The technology of aerosol plating", by Donald J. Levy in Technical proceedings 51st Annual Convention American Electroplaters' Society, St. Louis, 1964, pp. 139–149.

The metal layer provided on the electrically conductive layer by electrodeposition usually is a nickel layer. The electrodeposition or galvanization bath comprises an aqueous acid solution of a salt of the desired metal. The acid solution does not attack the fully exposed resist layer because it is protected by the electrically conductive layer, for example, a metal layer provided by the aforesaid electroless deposition. Moreover most of the resist materials are not soluble in an aqueous acid medium.

After development and removal of the patternwise irradiated parts of the photoresist layer, the remaining parts of said layer also can be irradiated in a much later stage of the process according to the invention namely after the separation of the metal peel from the master disc. The irradiation can be performed from the air.

Thus in a further preferred embodiment of the method according to the invention, after separating the metal peel from the master matrix, the portions of the photoresist material adhering to the metal peel are irradiated and subsequently removed by dissolution in an aqueous medium.

The metal matrix obtained according to the invention which is derived from the master disc may be used for the production of the information carriers formed of synthetic resin. It is to be preferred, however, to manufacture from this matrix, which is sometimes called father matrix, further metal copies by electrodeposition (mother matrix) which in their turn are again copied by electrodeposition so as to obtain the so-called son matrices or dies. The latter are then used for the manufacture of information discs of synthetic resin. In the manufacture of the mother matrix, usually the electroless deposited conductive layer of the father matrix, for example an Ag layer, is first removed by treatment in an alkaline aqueous medium which comprises an oxidation agent, for example $H_2O_2$. The exposed metal surface, usually an Ni surface, is then oxidized over a depth of approximately 10 nm. This is also done in an alkaline aqueous medium. As a result of the oxidation, or in more general terms as a result of the passivation of the nickel surface, the motor matrix can easily be removed from the father matrix. In the reaction medium of the desilvering and passivating process the irradiated photoresist material dissolves. The separate treatment of the father matrix in an aqueous alkaline medium or preferably with a developing liquid is not deemed to be strictly necessary but is recommended to obtain reproducibly good results. Any portion of photoresist material adhering to the father matrix causes pits in the motor matrix and cockles in the son matrix derived herefrom. In the case in which the electroless deposited conductive layer consists of the same material (for example, Ni) as the electrodeposition metal layer, a removal of the former layer is not necessary.

The invention also relates to a novel intermediate product obtained when carrying out the method comprising a supporting plate which has a photoresist layer on at least one side which comprises an information track and is covered with an electrically conductive layer and in which the photoresist layer is a fully irradiated layer.

The intermediate product is a new type of master disc and is an attractive commercial product for soft-ware manufacturers. Buyers of this product, such as producers of matrices can process the product into the described metal matrices in an improved and simple manner.

Figure 2:
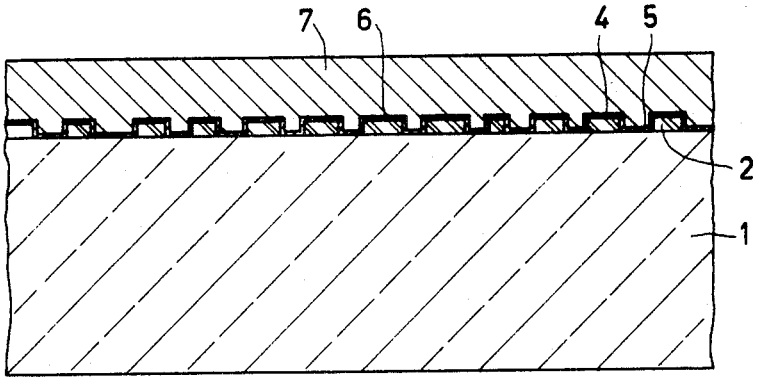
FIG. 2 is a cross-sectional view of a master disc employed in the method of the invention.
Figure 3:
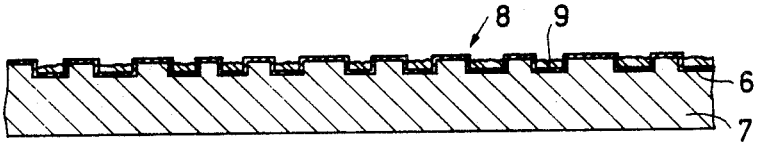
FIG. 3 is a cross-sectional view of a father matrix with adhering portions of the photoresist layer.
Figure 4:
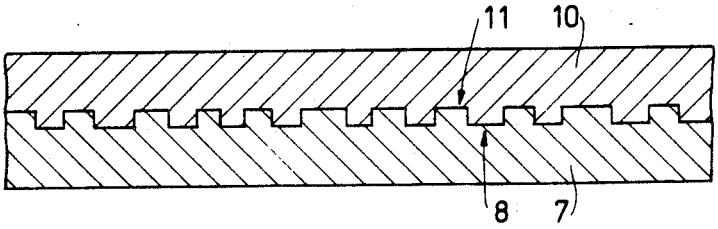
FIG. 4 is a cross-sectional view of a father matrix provided with an electrodeposited metal layer forming a mother matrix upon separation.

The invention will now be described in greater detail with reference to the following embodiment and the drawing, in which FIG. 1 is a cross-sectional view of the intermediate product according to the invention, FIG. 2 is a cross-sectional view of a master disc having an electrodeposited metal layer used in the method in accordance with the invention, FIG. 3 is a cross-sectional view of a father matrix on which remaining parts of photolacquer are present, FIG. 4 is a cross-sectional view of a father matrix having an electrodeposited metal layer, which latter after separation forms a mother matrix.

EMBODIMENT

Reference numeral 1 in FIG. 1 denotes a 5 mm thick glass disc having a diameter of 240 mm. The glass disc is provided on one side with a photoresist layer 2 which after drying has a layer thickness of 0.2 μm. The positive photoresist used is a derivative of naphtoquinone diazide commercially available as Hunt Waycoat type HPR 204. The resist layer is irradiated by pulsated laser light which is modulated in accordance with the information to be written. The resist layer thus irradiated in the form of a desired pattern is developed with a solution of 10 g of NaOH and 50.5 g of $Na_4P_2O_7.10H_2O$ in 4.5 liters of water. As a result of this the irradiated parts of the photoresist layer are dissolved and a spiral-like information track 3 is formed which has a crenellated profile of information areas 4 situated at a higher lever alternated by information areas 5 situated at a lower level. The longitudinal dimensions of the these areas vary from approximately 0.2 to 3 μm in accordance with the stored information. The difference in height between the information areas is approximately 0.1 μm. The areas can be read optically. After developing and drying the photoresist layer 2, the remaining parts are irradiated with the light of a 500 W super high pressure Hg lamp for 4 minutes. Subsequently a layer of silver 6 is vapor-deposited on the resist layer 2 having an information track. The thickness of the silver layer is 0.12 μm.

A nickel layer 7 is grown by electrodeposition on silver layer 6 to a thickness of 400 μm shown in FIG. 2.

The metal peel consisting of the nickel layer 7 and the silver layer 6 connected to the nickel layer is removed from glass disc 1 provided with photoresist layer 2. Portions 9 (FIG. 3) of the photoresist layer 2 adhere to the above-mentioned metal peel. The information track 8 present in metal peel 6, 7 is a copy of information track 3 (FIG. 1). The situation is shown in FIG. 3.

The portions 9 are removed by treating the metal peel 6, 7 with a solution of 10 g of NaOH and 50.5 g of $Na_4P_2O_7.10H_2O$ in 2 liters of water. Then metal peel 6, 6 is rinsed with water. The quality of the surface of the metal peel 6, 7 is excellent: no damage, no contamination such as drying spots and no remaining photo-lacquer being found. A metal print (mother matrix) is manufactured from the resulting father matrix by first removing the silver layer 6. For this purpose the silver layer is dissolved in an aqueous alkaline solution of $H_2O_2$. The uncovered surface of nickel layer 7 is passivated by treatment with an aqueous solution of $K_2Cr_2O_7$ and the nickel layer 7 is then provided on the side of the information track 8 with an electrodeposited Ni layer 10 (FIG. 4). After separating Ni layer 10 which comprises an information track 11 which is a copy of information track 8, the mother matrix which is not shown separately in the drawing is obtained.

In the same manner as described above, son matrices can be manufactured by electrodeposition from this mother matrix. By means of the son matrix, information carriers of synthetic resin are manufactured, for example, by using an injection moulding process. The mother matrix, the son matrix and the synthetic resin information carriers all have excellent surface qualities.

What is claimed is:

1. A method of manufacturing a metal matrix at least one surface of which comprises an information track readable by an optical beam or similar means said method comprising:

(a) depositing on at least one surface of a transparent supporting plate a photoresist layer;

(b) exposing said photoresist layer to radiation in a pattern conforming to a desired information track;

(c) developing said photoresist layer with a positive-acting aqueous developer to thereby dissolve said exposed portions of said photoresist layer and thereby form said information track in said photoresist layer on said supporting plate;

(d) depositing an electrically conductive layer on the surface of said photoresist layer containing said information track;

(e) applying by electric deposition a metal layer on said electrically conductive layer, said metal layer and said electrically conductive layer together constituting a peelable metal layer;

(f) exposing, through said transparent supporting plate, the entire surface of said photoresist layer containing said information track to radiation;

(g) peeling said peelable metal layer from the surface of said photoresist containing said information track thereby forming a metal matrix a surface of which contains an information track and (h) exposing the surface of said metal matrix containing the information track to a positive-acting aqueous developer thereby removing from said surface any adhering photoresist material.

2. The method of claim 1 wherein the electrically conductive layer is deposited by evaporation.

3. The method of claim 1 wherein the positive-acting aqueous developer is an aqueous alkaline solution.

4. A master disc, obtained in carrying out the method of claim 1, comprising a supporting plate provided on at least one side with a photoresist layer containing an information track covered with an electrically conductive layer and characterized in that said photoresist layer is a fully irradiated layer.

* * * * *